US008052239B2

(12) United States Patent
Arakawa et al.

(10) Patent No.: US 8,052,239 B2
(45) Date of Patent: Nov. 8, 2011

(54) DRIVING APPARATUS OF INKJET HEAD

(75) Inventors: Hiroaki Arakawa, Uenohara (JP); Tetsuo Uno, Tokyo (JP); Masakazu Mori, Sagamihara (JP)

(73) Assignee: Konica Minolta Holdings, Inc., Tokyo (JP)

( * ) Notice: Subject to any disclaimer, the term of this patent is extended or adjusted under 35 U.S.C. 154(b) by 1076 days.

(21) Appl. No.: 11/901,193

(22) Filed: Sep. 14, 2007

(65) Prior Publication Data

US 2008/0068410 A1 Mar. 20, 2008

(30) Foreign Application Priority Data

Sep. 20, 2006 (JP) ..... 2006-254739

(51) Int. Cl.
*B41J 29/38* (2006.01)

(52) U.S. Cl. ..... 347/9; 347/10

(58) Field of Classification Search ..... 347/9, 10
See application file for complete search history.

(56) References Cited

U.S. PATENT DOCUMENTS

| | | | |
|---|---|---|---|
| 6,270,180 | B1 | 8/2001 | Arakawa et al. |
| 6,390,580 | B1 | 5/2002 | Anderson et al. |
| 6,428,138 | B1 | 8/2002 | Asauchi et al. |
| 2003/0214544 | A1 | 11/2003 | Aihara |

FOREIGN PATENT DOCUMENTS

| | | | |
|---|---|---|---|
| EP | 0 900 657 | A | 3/1999 |
| JP | 05-138900 | A | 6/1993 |
| JP | 07-060967 | * | 3/1995 |
| JP | 07-060967 | A | 3/1995 |
| JP | 10-147010 | A | 6/1998 |
| JP | 2000-263770 | A | 9/2000 |
| JP | 2000-343729 | A | 12/2000 |
| JP | 2006-240048 | A | 9/2006 |

OTHER PUBLICATIONS

European Search Report and Written Opinion (in English) dated Jan. 21, 2010 issued in a counterpart European Application No. 07116258.0.

Japanese Office Action dated May 17, 2011 and English translation thereof in counterpart Japanese Application No. 2006-254739.

* cited by examiner

*Primary Examiner* — Uyen Chau N Le
*Assistant Examiner* — Kajli Prince
(74) *Attorney, Agent, or Firm* — Holtz, Holtz, Goodman & Chick, P.C.

(57) ABSTRACT

An inkjet head driving apparatus, wherein serial data indicating emission or non emission of nozzles respectively for a plurality of heads, is latched and memorized, and the nozzles are driven respectively based on the data memorized, the inkjet head driving apparatus having: an emission timing signal outputting device disposed in common for a plurality of heads so as to output a plurality of emission timing signals in one emission cycle; a setting device disposed respectively for the plurality of the heads so as to select the sequential emission timing signals at which emission starts synchronously, among the emission timing signals outputted from the emission timing signal outputting device in one emission cycle.

5 Claims, 6 Drawing Sheets

DRIVING APPARATUS OF INKJET HEAD

This application is based on Japanese Patent application No. 2006-254739 filed on Sep. 20, 2006, in Japanese Patent Office, the entire content of which is hereby incorporated by reference.

FIELD OF THE INVENTION

The present invention relates to a driving apparatus of an inkjet head, and in particular, to a driving apparatus of an inkjet head having a high landing accuracy capable of controlling emission timing respectively by a plurality of the heads or by a plurality of the nozzles provided at a head.

BACKGROUND OF THE INVENTION

Studies for uses of inkjet printers wherein a liquid droplet is emitted from a nozzle of a head to land the droplet on a recording material, in various fields of production technologies, for instance, production of a color filter such as a liquid crystal display unit and a plasma display unit besides an image recording use such as character, drawing patter and photograph have begun in recent yeas.

Accordingly, demands for the performance of the inkjet printer have been increasing more and more and a demand for fine control of an emission timing independently for each head or for each nozzle in less than an unit of one pixel is also increasing. For example, in production of the color filter, each ink droplet of RGB color is needed to be landed at a predetermined position in a matrix from the nozzle of the inkjet head with an accuracy of μ order which is less than the unit of one pixel. For this reason, it is required that landing is to be controlled highly accurately by fine adjustment less than the unit of one pixel for each head or for each nozzle.

Patent document: Tokkaihei 10-147010

In order to the control emission timing independently head by head or nozzle by nozzle, it is considered that data transmission systems have to be configured independently for each head or for each nozzle.

However, in case data transmission system is configured for each head, usually, it is necessary to output a serial clock, serial data, a latch for data transmission and an emission start signal for forming a drive wave respectively from the control circuit board, and the control circuit board and the head have to be connected by a plurality of signal cables. Therefore, the plurality of signal cables have to be connected for a plurality head respectively. Consequently, there was a problem that number of signal cables becomes enormous.

Also, in case the data transmission system is configured for each nozzle, the emission start signal has to be provided for each nozzle respectively, there is also a problem that the number of the signal cable also becomes enormous.

As above, to provide the signal cable for each head or each nozzle causes bulky large head, complication of wiring design and cost increase. It is a serious issue to reduce the number of the signal cables between the control circuit board and the head while the numbers of the heads and nozzles are increasing.

There is considered a configuration that serial clock, latch and emission start signal are transferred from the control circuit board to every head in common, and only serial data is transferred for each head so as to reduce the number of signal cables.

However, in this embodiment, emission of each head can be performed only at the same timing and positioning adjustment between each head can be performed only by a pixel by changing read-out from a memory where data is stored. Therefore, the demand of highly accurate landing by controlling landing by less than one pixel was not satisfied.

Further, as for changing of the emission timing for each nozzle, there is suggested that the drive wave for each nozzle is formed from the same emission signal after elapsing of a predetermined delay time for each nozzle. However, in this case, due to a fluctuation of a speed of a relative movement between the head and the recording material, a landing position changes, thus there was a problem that the accurate landing cannot be realized.

SUMMARY OF THE INVENTION

Then, an object of the present invention is to provide a driving apparatus of the inkjet head capable of controlling emission timing with high accuracy independently for a plurality of the heads without increasing the number of the signal cables.

Also, another object of the present invention is to provide a driving apparatus of the inkjet head capable of controlling emission timing with high accuracy independently for a plurality of the nozzles of the head without increasing the number of the signal cables.

The following reveals other objects of the present invention.

The above problems will be solved by each of the structures below.

1. An inkjet head driving apparatus having: an emission timing signal outputting device disposed in common for a plurality of heads so as to output a plurality of emission timing signals in one emission cycle; a counting device disposed in common with the plurality of the heads so as to count the emission timing signals; a setting device disposed respectively for the plurality of the heads so as to select the sequential emission timing signals at which emission starts synchronously, among the emission timing signals outputted from the emission timing signal outputting device in one emission cycle; a comparing device disposed respectively for the plurality of the heads so as to input a setting value of the setting device and a count value of the counting device and to output a signal when the values become equal; and a head drive wave forming device disposed respectively for the plurality of the heads so as to form a head drive wave for emission from an output from the comparing device and to output the head drive wave to the head; wherein serial data indicating emission or non emission of nozzles respectively for a plurality of heads, is latched and memorized, and the heads are driven respectively based on the data memorized.

2. An inkjet head driving apparatus, having: an emission timing signal outputting device disposed in common with a plurality of nozzles so as to output a plurality of emission timing signals in one emission cycle; a counting device disposed in common with the plurality of the nozzles so as to count the emission timing signals; a setting device disposed respectively for the plurality of the nozzles so as to select sequential emission timing signals at which emission starts synchronously, among the emission timing signals outputted from the emission timing signal outputting device in one emission cycle; a comparing device disposed respectively for the plurality of the nozzles so as to input a setting value of the setting device and a count value of the counting device, and to output a signal when the values become equal;

a selecting device disposed respectively for the plurality of the nozzles so as to input the signal outputted from the comparing device and data memorized, and to select whether or not the data is to be outputted; a head drive wave forming device disposed respectively for the plurality of the nozzles so as to form a nozzle drive wave for emission from an output of the selecting device, and to output the nozzle drive wave to the nozzles; wherein serial data indicating emission or non emission respectively for the plurality of the nozzles disposed at a head is latched and memorized, and the nozzles are driven respectively based on the data memorized.

DETAILED DESCRIPTION OF THE PREFERRED EMBODIMENT

The following describes an embodiment of the present invention with reference to the drawings.

Figure 1:
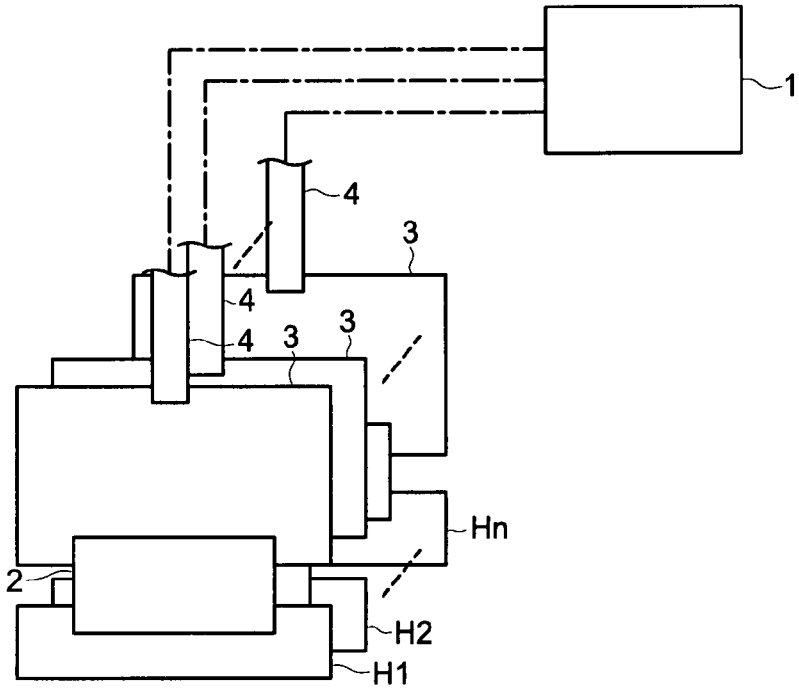
FIG. 1 is a block diagram showing an outline of inkjet heads.

FIG. 1 is a block diagram showing an outline of inkjet heads. H1, H2 . . . Hn show the heads respectively.

The heads H1, H2 . . . Hn reserve liquid supplied from an unillustrated ink cartridge and emit liquid droplets from predetermined nozzles based on predetermined signals given from a circuit board 1. Practical structures of the relevant heads H1, H2 . . . Hn are not restricted as far as they can emit the liquid droplets based on the predetermined signals, for example, a structure using an electrical mechanical conversion element such as a piezoelectric element, a structure using bubble break when the liquid is heated, and so forth can be used.

Each head H1, H2 . . . Hn is connected by cable 2 with each driver section 3 where driving IC to drive each head H1, H2 . . . Hn is equipped. A cable 2 and a driver section 3 are stored in an unillustrated casing with each head H1, H2 . . . Hn corresponding so as to configure each head unit. Each head unit is connected by a signal cable 4 such as a flexible cable in between each driver 3 and the control circuit board 1.

Figure 2:
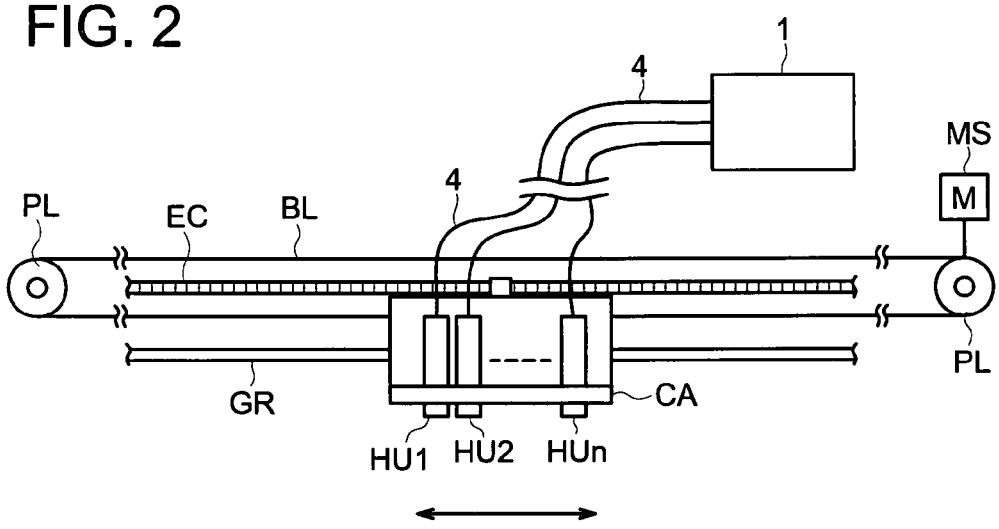
FIG. 2 is a schematic block diagram showing an example of a printer.

FIG. 2 is a schematic block diagram showing an example of a printer equipped with the such head units.

Generally, head unit HU1, HU2 . . . HUn are provided for each color such as YMCK and RGB, and a plurality of the head units HU1, HU2 . . . HUn are mounted on common carriage CA. Carriage CA mounting the head units HU1, HU2 . . . HUn is slidably engaged with a guide rail GR. With guide of the guide rail GR, the carriage CA is provided to be capable of reciprocate along a main scanning direction of the printer shown by an arrow.

Carriage CA is fixed with belt BL trained about two pulleys, which are disposed in the main scanning direction with a predetermined distance, and reciprocates along the guide rail GR through rotation of belt BL which is rotated by either of pulleys PL driven by main scanning motor MS.

An encoder EC is suspended parallel to the guide rail GR so as to obtain position data as a pulse signal when the carriage CA reciprocates along the main scanning direction.

Then, each head unit HU1, HU2 . . . HUn emits the liquid droplet from the predetermined nozzle at a predetermined timing while the carriage CA reciprocates along the main scanning direction at a constant speed so as to land the droplet on an unillustrated recording material.

Figure 3:
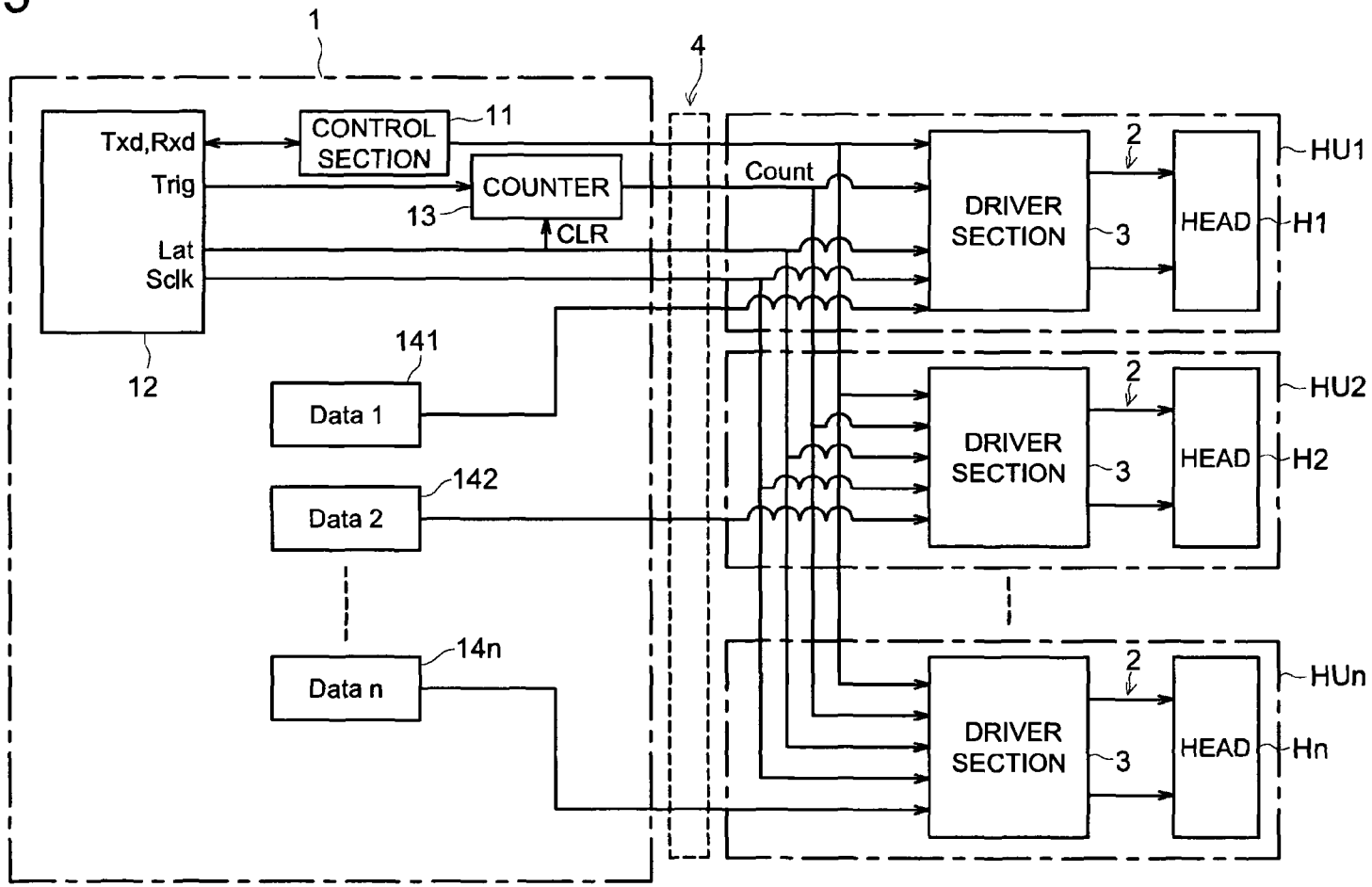
FIG. 3 is a block diagram showing a first embodiment of a drive apparatus of an inkjet head related to the present invention.
Figure 4:
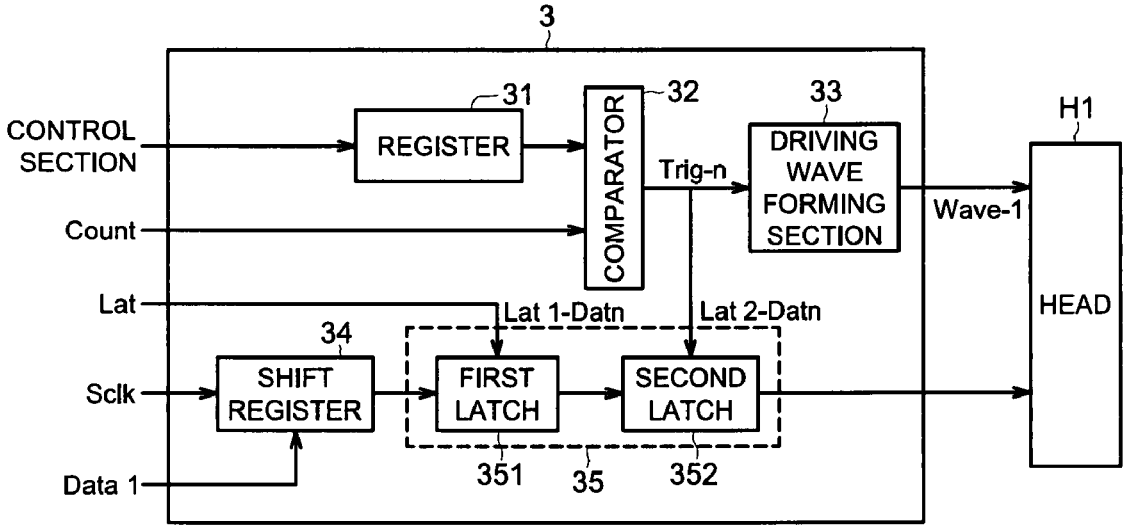
FIG. 4 is a block diagram showing a structure of a driver section of a first embodiment.

FIG. 3 is a block diagram showing a first embodiment of the driving apparatus to drive such inkjet head, and FIG. 4 is a block diagram showing a structure of a driver section 3 in the drive apparatus. Meanwhile, since the driver section 3 in each head unit HU1, HU2 . . . HUn has the same structure, FIG. 4 shows the driver unit 3 in the head unit HU1. Also, in FIG. 3 and FIG. 4, the same symbols denote the same structure.

The control circuit board 1 is disposed in common for a plurality of the head units HU1, HU2 . . . HUn and provide with a control section (CPU) 11, a communication interface 12, a counter 13, serial data 141, 142 . . . 14*n* for each head.

The control section 11 performs transmission and reception of control signals (Txd, Rxd) through the communication interface 12 and outputs setting values to a register 31 to be described representing a setting device for each driver section 3 via signal lines 4.

A counter 13 is a counting device to receive and count a trigger signal (Trig) representing an emission timing signal sent from the communication interface 12, and outputs the count value to a comparator 32 representing comparing device 32 of each driver section 3 respectively via the signal line 43.

Here, the trigger signal is formed by a pulse signal obtained by the encoder EC which detects position data along the main scanning direction of the carriage CA provided with the plurality of head units HU1, HU2 . . . HUn. Thus, the encoder EC is also an emission timing signal outputting device of the present invention.

While FIG. 2 shows the encoder EC which is a linear encoder disposed along the main scanning direction, it can be a rotary encoder to obtain the pulse signal by rotation of main scanning motor MS. In the present invention, for a purpose of performing emission in a high accuracy timing, there is preferred an encoder capable of obtaining a pulse signal of 10 kHz to 1 MHz which has a more high-resolution than emission cycle of each head H1, H2 . . . Hn. For this purpose, an incremental rotary type encoder is preferably used.

Each serial data 141, 142 . . . 14*n* is data showing emission and non-emission for each nozzle corresponding to head H1, H2 . . . Hn, and stored in an unillustrated data memory to be outputted to shift register 34 of each driver section 3 corresponding via the signal line 4.

Also, the communication interface 12 outputs a latch signal (Lat) to a latch 35 of each driver section 3 via the signal line 4 and outputs a serial clock (Sclk) for data transmission to shift a register 34 of each driver section 3 via the signal line 4.

Latch signal is outputted in a predetermined interval corresponding to an emission cycle of the Head H1 (a specific cycle of H1 from emission to a timing where subsequent emission becomes possible). Contrarily, the trigger signal is outputted with a higher frequency than the latch signal. Thus, the counter 13 counts a plurality of the trigger signals within a period from outputting of the latch signal to outputting of the following signal. Meanwhile, the trigger signals representing the emission timing signals are not necessary to be outputted in the same interval within these two latch signals.

The counter 13 is configured so that a signal corresponding to the latch signal is inputted when the latch signal is outputted. The counter 13 resets previous count value of the trigger signals when the signal corresponding to the latch signal is inputted. In this way, by resetting the count value of the counter 13 with the signal corresponding to the latch signal, each head H1, H2 . . . Hn can be synchronized by every latch signal to start emission at an assigned trigger position.

Here, the signal corresponding to the latch signal includes signals created by the latch signal as well as the latch signal itself.

A setting value to determine, which sequential trigger signal among a plurality of trigger signals outputted between the latch signal and the following latch signal, at which trigger signal the emission synchronously starts, is sent from the control section 11 of the control circuit board 1 and memorized in the register 31 of the driver section 3. The value memorized here is rewritable for every single main scanning of the carriage CA.

The setting value in register 31 is outputted to the comparator 32. In the comparator 32, the setting value in the register 31 and the count value outputted from the counter 13 of the control circuit board 1 are compared and when the setting value and the count value become equal, an emission start signal (Trig-n) is outputted to a drive wave forming section 33 representing a head drive wave forming device, at the same time, it is outputted to the latch 35.

Receiving the emission start signal from the comparator 32, the drive wave forming section 33 forms a head drive wave signal to the drive head H1 and boosts a voltage of a power source so that a voltage of the signal becomes a sufficient level to drive the head H1. Output ports of the drive wave forming section 33 corresponded are connected to the plurality of nozzles disposed at the head H1 respectively, (hereinafter, described as 256 nozzles, though the number of nozzles are not limited to this number), and the drive signal (Wave-1) is applied to each nozzle in accordance with data.

A shift register 34, memorizes 256 pieces of serial data transmitted from control circuit board 1 for nozzles, namely data for a single emission cycle of each nozzle of the head H1. To shift register 34, the data for each nozzle is serially transmitted synchronously with serial clock transmitted from control circuit board 1, and the data for all 256 nozzles is memorized the shift register and then the data is further memorized in latch 35 by a latch signal also outputted from the control circuit board 1.

Here, the latch 35 is configured with a two-stage latch including a first latch 351 representing a first memory device and a second latch 352 representing a second memory device. The first latch 351 latches and memorizes serial data for 256 nozzles memorized in the shift register 34 by a latch signal from the control circuit board 1. The second latch 352 receives a signal from the comparator 32 and further latches and memorizes the data memorized in the first latch 351 and memorize.

As above, since the latch 35 is provided with the first latch 351 and second latch 352, outputting of the data can be delayed until the drive signal, that is created at a timing of the emission start signal (Trig-n) representing an output of the comparator 32, is outputted, thereby there is an effect that output of the drive signal to each head and output of data transmission can be synchronized. Thus there is not occurred a problem that the data is changed by next data while the head is in a state of emission operation based on data.

The output signal of the comparator 32 is imputed to the second latch 352. The second latch 352 receives the output signal from the comparator 32 and outputs the data for 256 nozzles memorized therein to each nozzle of the head H1.

On the other hand, from the drive wave forming section 33, the drive signal is applied to each nozzle of the head H1 based on the data for 256 nozzles memorized in the second latch 352 and each nozzle is controlled to emit or not to emit.

Figure 5:
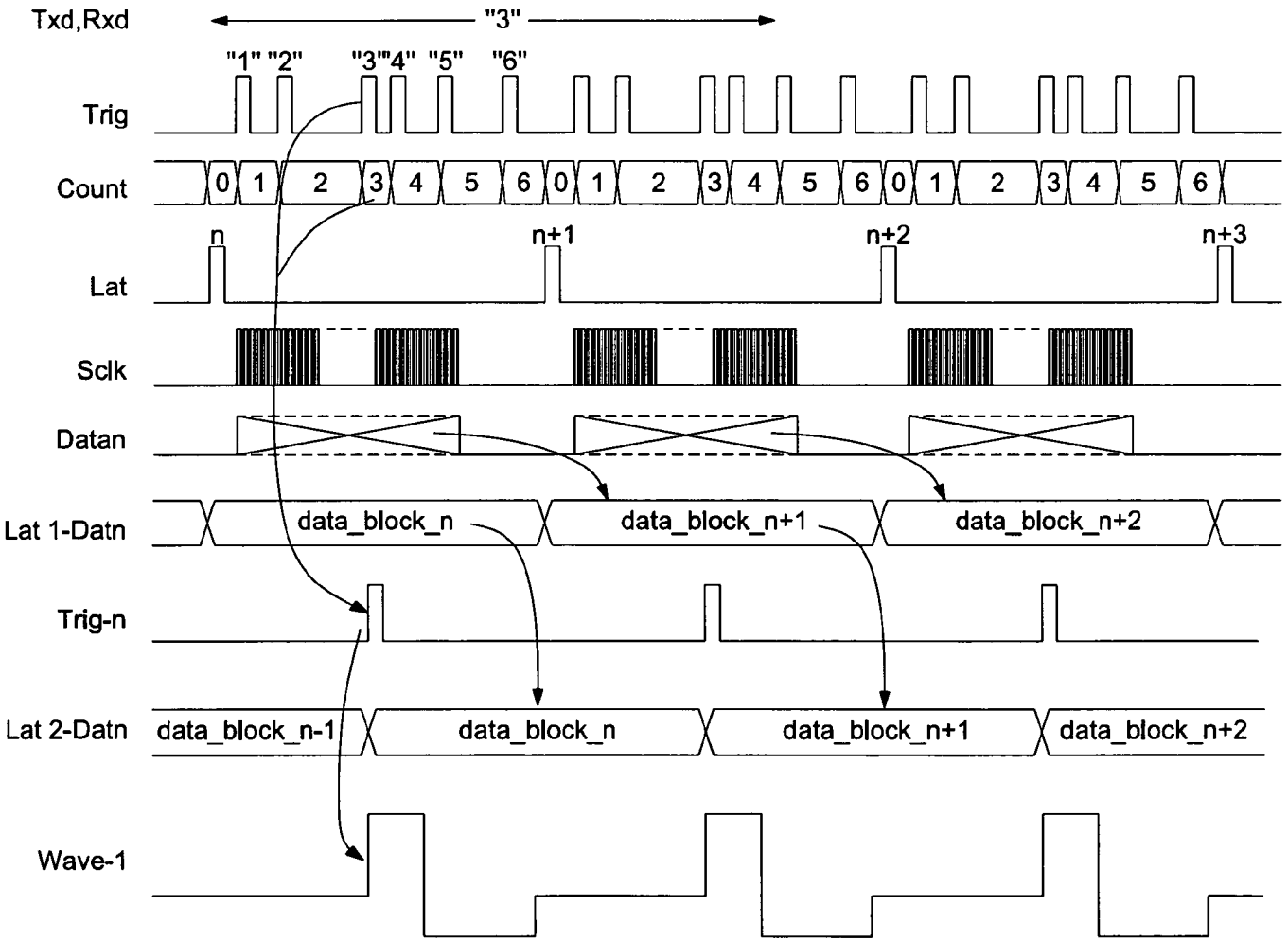
FIG. 5 is a timing chart showing drive operation of a driving apparatus of an inkjet head related to a first embodiment.

Next, a specific drive operation of an driving apparatus of the inkjet head related to the present invention will be described with reference to a time chart shown in FIG. 5. Here also, only the head unit HU1 is described.

Here, to the driver section 3 of the head unit HU1, the control circuit board 1 outputs the trigger signals for 6 pulses in one emission cycle. In the present invention, the trigger signals, which actually cause to start emission synchronously, can be arbitrarily selected among a plurality of the trigger signals in this one emission cycle for each head unit HU1, HU2 . . . HUn. Here, by outputting the setting value of "3" from the control section 11 of the control circuit board 1, the setting value "3" is memorized in advance in the register 31 of driver section 3 in head unit HU1 so that emission starts synchronously with the third trigger signal.

Now, after a latch signal (n) representing a delimiter of the emission cycle is outputted, serial data for the following emission cycle of each nozzle of the head H1 is outputted to the shift register 34 of the driver section 3 from the data memory 141 of the control circuit board 1 synchronizing with a serial clock. When the serial data for 256 nozzles is stored, the shift resister 34 is latched by the following latch signal (n+1), and the data is memorized in the first latch 351 as data (Lat1-Datn). In FIG. 5, "Data_block_n+1" denotes this data block.

In an emission cycle between the aforesaid latch signal (n) and the latch signal (n+1), the counter 13 of the control circuit board 1 counts the trigger signals outputted within this period and continues to output the count value to the comparator 32.

Here, the comparator 32 outputs the emission start signal (Trig-n) to the drive wave forming section 33 when the count value becomes equal to the setting value "3" memorized in the register 31. Thereby the drive signal (Wave-1) is outputted to the head H1 based on the parallel data (Lat2-Datn) of data block "Data_block_n" in the emission cycle before the aforesaid "data_block_n+1" which is memorized in the second latch 352 so as to control each nozzle to emit or not to emit.

Also, the comparator 32 outputs the aforesaid emission start signal (Trig-n) to the wave forming section 33, at the same time it outputs a signal to the second latch 352. Receiving the output signal, the second latch 352 further memorizes the data of the aforesaid block data "data_block_n+1" stored in the first latch 351 to be parallel data (Lat2-Datn).

In the same manner, the parallel data (Lat2-Datn) of the aforesaid data block "Data_block_n" memorized in the second latch 352 is outputted to the head H1 by the emission start signal (Trig-n) outputted from the comparator 32 to the drive wave forming section 33 when the count value of the counter 13 becomes "3" in a period of one emission cycle between the latch signal (n+1) and the subsequent latch signal (n+2), then each nozzle are controlled to emit or not to emit based on the parallel data thereof.

Other head units HU2 . . . Hun are operated in the same manner as above. In this case, individual timing can be set respectively for each head unit HU1, HU2 . . . Hun by the control section 11 of the control circuit board 1 to set each arbitral value in the register 31 of other head units HU2 . . . HUn.

As above, it is not necessary to connect a plurality of the signal lines such as the trigger signal (Trig), the latch signal (Lat) and the serial clock (Sclk) to each head unit HU1, HU2 . . . HUn individually, because the trigger signals (Trig) are outputted in common to each head unit HU1, HU2 . . . HUn and the drive section 3 of each head unit HU1, HU2 . . . HUn can independently select at which number trigger signal the start of emission is synchronized. Therefore, as FIG. 3 shows, number of signal lines 4 connecting the control circuit board 1 and each head unit HU1, HU2 and HUn is reduced and a circuit structure can be simplified. Thus the problems of bulky head, convolution of circuit design and cost increase can be solved.

Further, because the emission can be started synchronously with arbitral timings of a plurality of trigger signals (Trig) outputted in one emission cycle for each head H1, H2 . . . Hn, the emission timings of heads H1, H2 . . . Hn can be set respectively for each head H1, H2 . . . Hn with a fine resolution independently from a maximum emission frequency of heads H1, H2 . . . Hn, thus high accuracy landing can be realized.

Figure 6:
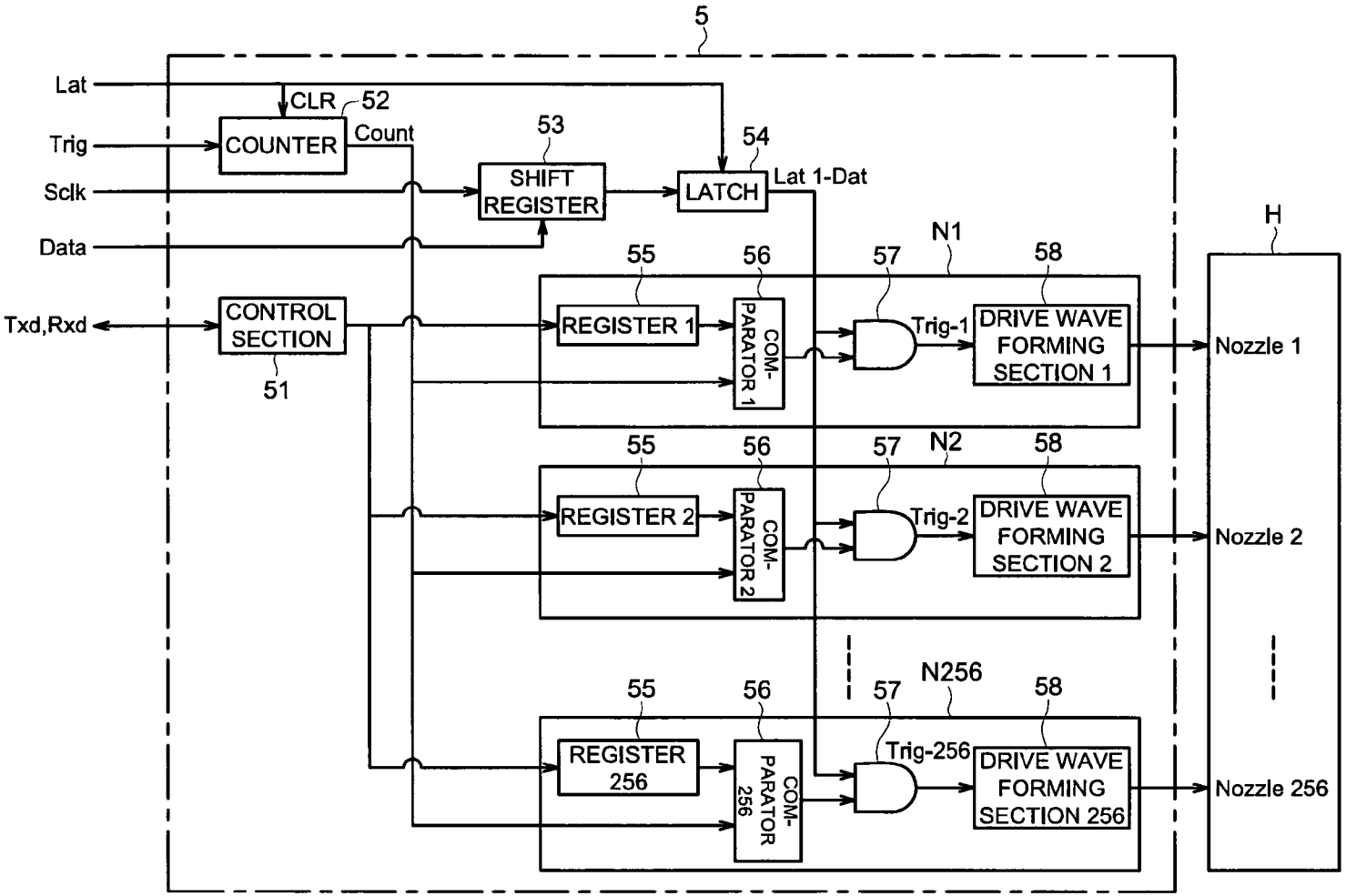
FIG. 6 is a block diagram showing a second embodiment of a driving apparatus of an inkjet head related to the present invention.

FIG. 6 is a block diagram showing a second embodiment of a driving apparatus of an inkjet head related to the present invention.

This apparatus is characterized that the emission timing is controlled independently for the plurality of nozzles provided at one head H (here, the number of the nozzle is not limited while the apparatus for 254 nozzles are described).

In the figure, the numeral 5 denotes a driver section of one head H, where transmission and reception of the latch signal (Lat), the trigger signal (Trig), the serial clock (Sclk) and the serial data (Data) from/to an unillustrated control circuit, and transmission and reception (Txd, Rxd) of various signals are carried out.

At a driver section 5, a control section 51, a counter 52, a shift resister 53 and a latch 54 are disposed to be common for each nozzle from a nozzle 1 to a nozzle 256 of the head H, and each nozzle drive section N1, N2 . . . N256 is disposed corresponding to each nozzle from nozzle 1 to nozzle 256 of head H.

The control section 51 carries out transmission and reception (Txd, Rxd) of control signals from the control circuit board and outputs the later described setting values via signal lines to a register 55 representing a setting device for each nozzle drive section N1, N2 . . . N256.

A counter 52 is a counting device to receive and count a plurality of trigger signals (Trig) representing emission timing signals sent from the control circuit, and outputs the count value to a comparator of each nozzle drive section N1, N2 . . . N256.

This trigger signal is the same as the one described in the above mention first embodiment and created by a pulse signal obtained by an encoder.

Serial data (Data) for each of nozzle 1 to nozzle 256 of the head H is the data indicating emission or non emission for each of nozzle 1 to nozzle 256, and is outputted from the control circuit board via the signal lines to the shift register 53 disposed at the driver section 5 in common for each of nozzle 1 to nozzle 256, then is memorized in the shift resister 53 synchronously with the serial clock (Sclk) also sent from the control circuit board for data transmission.

Also, the latch signal (Lat) sent form the control circuit board via the signal line is inputted to the latch 54 disposed in common for each of nozzle 1 to nozzle 256 at the driver section 5.

The latch signal is outputted with a consistent interval corresponding to the emission cycle (a specific cycle of H1 from emission to a timing where subsequent emission becomes possible) of the head H. Contrarily the trigger signal is outputted with a higher frequency than that of the latch signal. Therefore, the counter 52 counts a plurality of the trigger signals in a period from output of a latch signal to output of the subsequent latch signal. Meanwhile, the trigger signal representing the emission timing signal of the present invention is not necessary to be outputted in the consistent interval between these two latch signals.

The latch signal is outputted also to the counter 52 at the same time. When the latch signal is inputted, the count value of previous trigger signals is reset.

As above, the count value of the counter 52 is reset by a signal related to the latch signal, thereby each of nozzle 1 to nozzle 256 can be synchronized with the latch signal each time so as to emission is started at a preset trigger position.

Hereat, the signal related to the latch signal includes signals created by the latch signal besides the latch signal itself.

Shift register 53 memorizes 256 items of serial data for nozzles sent from the control circuit, namely, the data of one emission cycle for each of nozzle 1 to nozzle 256 of the head H. To the shift register 53, the data for each nozzle is transmitted serially synchronously with the serial clock sent from the control circuit, and when all the data for 256 nozzles is memorized, the data is again memorized in the latch 54 representing memory device by the latch signal also outputted from the control circuit. The parallel data for 256 nozzles memorized in the latch 54 is outputted to the later described AND circuit 57 disposed at each of nozzle drive sections N1, N2 . . . N256.

Each of nozzle drive sections N1, N2 . . . N256 has a register 55, a comparator 56, an AND circuit 57 and a drive wave forming section 58 respectively.

A setting value to determine at which number trigger signal among a plurality of the trigger signals outputted between the latch signal and the subsequent latch signal, the emission stars synchronously, is sent from the control section 51 to each of nozzle drive section N1, N2 . . . N256 respectively and memorized in register 55. The setting value memorized here, is rewritable for every single scanning of the carriage CA.

The setting value of the register 55 is outputted to the comparator 56. In comparator 56, the setting value of register 55 and the count value outputted from the counter 52 are compared, and when the setting value and the count value become equal, a signal is outputted to the AND circuit 57.

The AND circuit 57 outputs the emission start signals (Trig-1, Trig-2 . . . Trig 256) to the drive wave forming section 58, when the data (emission data) to cause emission from the nozzles corresponding the parallel data (Lat1-Dat) sent from the latch 54, and an input of an output signal from the aforesaid comparator 56 are present.

Receiving the emission start signal (Trig-1, Trig-2 . . . Trig-256) from the AND circuit 57, the drive wave forming section 58 forms a head drive wave signal to drive each of nozzle 1 to nozzle 256 of the head H, and shifts the level of a power source up to a voltage sufficient to drive the head H and applies a drive signal to each of nozzle 1 to nozzle 256 according to the data.

Figure 7:
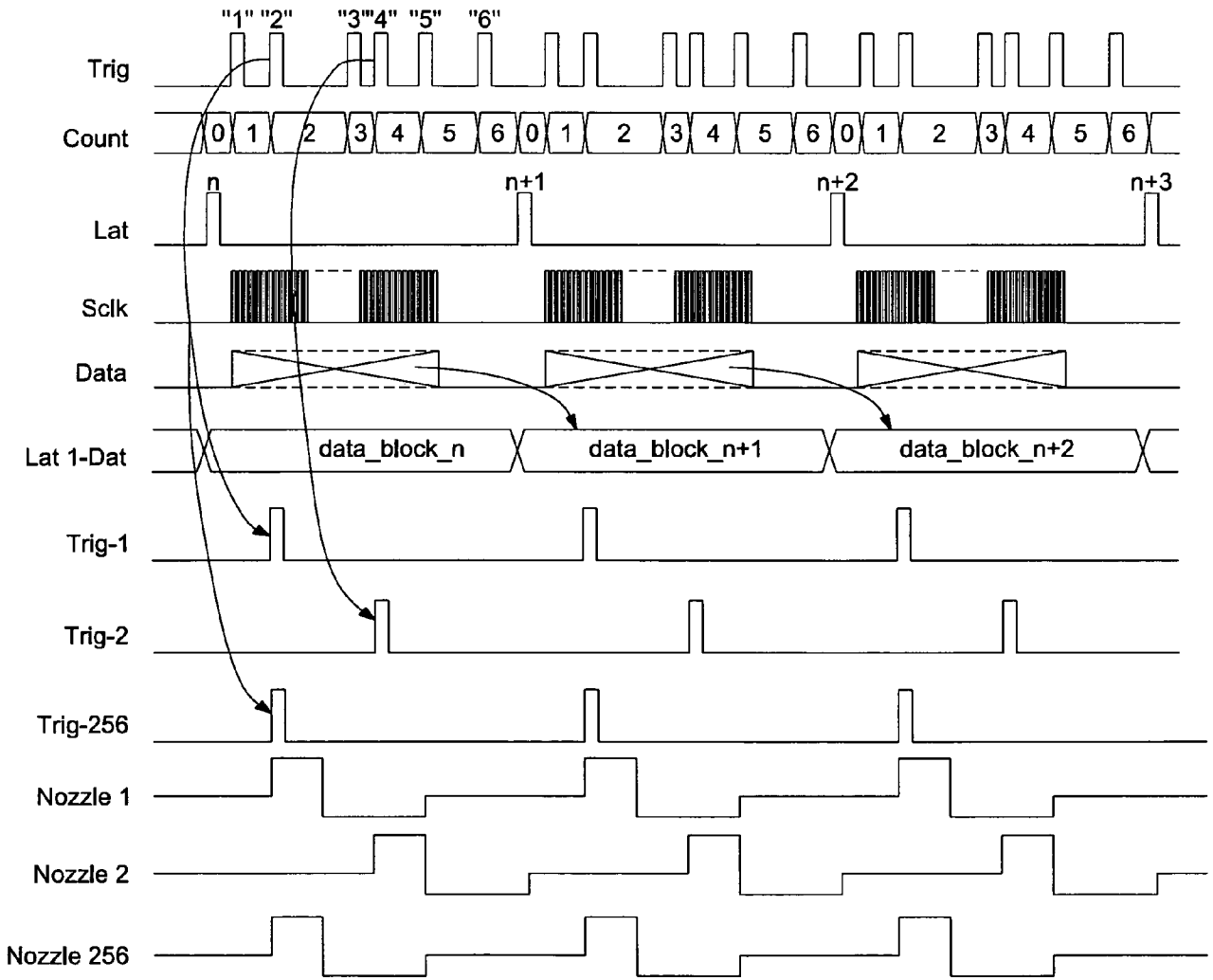
FIG. 7 is a timing chart showing drive operation of an inkjet head related to a second embodiment.

Next, specific drive operation of the driving apparatus of the inkjet head related to a second embodiment is described with reference to the timing chart shown in FIG. 7.

Hereat, it is assumed that the trigger signals for six pulses in one emission cycle are outputted to the driver section 5. In the present embodiment, the trigger signals to start emission from each of nozzle 1 to nozzle 256 synchronously can be selected arbitrarily among a plurality of the trigger signals in this single emission cycle. Here, operation of three nozzles i.e. nozzle 1, nozzle 2 and nozzle 256 will be explained.

It is presupposed that as for nozzle 1, setting value "2" is memorized so that emission is started by outputting setting value "2" from the control section 51 to the register 55 of a nozzle drive section N1; synchronizing with a second trigger signal, as for nozzle 2, setting value "4" is memorized so that emission is started by outputting setting value "4" from the control section 51 to the register 55 a the nozzle drive section N2, synchronizing with a fourth trigger signal, and as for nozzle 256, setting value "2" is memorized so that emission is started by outputting setting value "2" from the control section 51 to the register 55 of a nozzle drive section N256, synchronizing with a fourth trigger signal.

Now, after the latch signal (n) delimiting the emission cycle is outputted, serial data for subsequent one emission cycle of each of nozzle 1 to nozzle 256 of head H is outputted from the control circuit board to the shift register 53 of the driver section 5, synchronously with a serial clock. When the serial data for 256 nozzles is stored in shift register 53, the serial data is latched by the subsequent latch signal (n+1), then stores in latch 54 to be data (Lat1-dat). In FIG. 7, this data block is called "Data_block_n+1".

In an emission cycle between the aforesaid latch signal (n) and the latch signal (n+1), the counter 52 of the driver section 5 counts the trigger signals outputted in this period and continues to output the count values to the comparator 56 of each of nozzle drive sections N1, N2 . . . N256.

Here, each comparator 56 outputs a signal to corresponding AND circuit 57 when the setting value memorized in each register 55 corresponding becomes equal to the count value. Here, for nozzle 1 and nozzle 256, a signal is outputted when the count value of the trigger signals becomes "2" and for nozzle 2, the signal is outputted when the count value of the trigger signals becomes "4".

Each AND circuit 57 outputs output the emission start signals (Trig-1, Trig-2, Trig-256) to corresponding drive wave forming section 58 when the data of corresponding nozzles among data of nozzle 1, nozzle 2 and nozzle 256 memorized in the latch 54 is the emission data, and the signal is outputted from corresponding comparator 56 as above. Thereby a drive signal is outputted to the head H so as to control emission of the nozzle 1, nozzle 2 and nozzle 256 based on the parallel data (Lat1-Dat) of the data block "data_block_n" in a previous emission cycle of the aforesaid data block "data_block_n+1" memorized in the latch 54.

Also, with the data of the aforesaid data block "Data_block_n+1" memorized by the latch signal (n+1) in the latch 54, nozzle 1, nozzle 2 and nozzle 256 are controlled to emit synchronously with each of trigger signals, second, fourth and second, by counter 52 to count the trigger signals outputted from the control circuit board in a period between a latch signal (n+1) and the subsequent latch signal (n+2).

As the above, it is not necessary to connect 256 output signals for the plurality of nozzle 1 to nozzle 256 of one head H, and as FIG. 6 shows, timing adjustment for each of nozzle 1 to nozzle 256 is possible without increasing number of the signal lines which connect the control circuit board and the driver section 5 of the head H. Thereby, the problems of bulky head, complication of wiring design and cost increase can be solved.

Further, since emission can be started synchronously with arbitrary timing of a plurality of trigger signals (Trig) outputted in one emission cycle independently for each of nozzle 1 to nozzle 256 of one head H, the emission timing can be set with a fine resolution for each of nozzle 1 to nozzle 256 without depending on the maximum emission frequency of the head H, thereby a highly accurate landing can be realized.

The driving apparatus of each inkjet head described above, can be applied to fields of production technology which requires highly accurate landing by fine control of liquid droplet emission from each nozzle or each head, as well as to a printer for general image forming use, and it is particularly preferred to be applied to an inkjet had driving apparatus disposed at a printer for producing a color filter used in a liquid crystal display device and a plasma display.

According to the embodiments, it is possible to provide a driving apparatus of the inkjet head, which enables highly accurate landing, capable of controlling emission timing with high accuracy independently for a plurality of heads without increasing the number of the signal cables.

Also, according to the embodiments, it is possible to provide a driving apparatus of the inkjet head, which enables highly accurate landing, capable of controlling emission timing with high accuracy independently for a plurality of nozzles of the head without increasing the number of the signal cables.

What is claimed is:

1. An inkjet head driving apparatus comprising:

an emission timing signal outputting device disposed in common for a plurality of heads so as to output a plurality of emission timing signals based on position data in one emission cycle;

a counting device disposed in common for the plurality of the heads so as to count the emission timing signals and to be reset for each emission cycle;

setting devices disposed respectively for the plurality of the heads so as to select sequential emission timing signals at which emission starts synchronously, among the emission timing signals in one emission cycle outputted from the emission timing signal outputting device;

comparing devices disposed respectively for the plurality of the heads so as to input a setting value of the setting device and a count value of the counting device and to output a signal when the values become equal;

head drive wave forming devices disposed respectively for the plurality of the heads so as to form a head drive wave for emission from the signal outputted from the comparing device and to output the head drive wave to the head;

first memory devices disposed respectively for the plurality of heads so as to latch and memorize serial data for one cycle of all nozzles representing emission or non emission of nozzles of the head; and second memory devices disposed respectively for the plurality of heads so as to further latch and memorize the data memorized in the first memory device;

wherein the heads are driven respectively based on the memorized serial data.

2. The inkjet head driving apparatus of claim 1, wherein the counting device resets the count value synchronously with a signal related to a latch signal which latches the serial data to be memorized.

3. The inkjet head driving apparatus of claim 1, wherein a latch signal for the second memory device is the output signal from the comparing device.

4. The inkjet head driving apparatus of claim 1, wherein the plurality of the emission timing signals in one emission cycle are outputted in different intervals.

5. The inkjet head driving apparatus of claim 1, wherein the emission timing signals which actually cause emission can be selected arbitrarily among the plurality of the emission timing signals in one emission cycle by setting the setting value for each head.

* * * * *